US006726023B2

(12) United States Patent
Junnila et al.

(10) Patent No.: US 6,726,023 B2
(45) Date of Patent: Apr. 27, 2004

(54) METHOD AND ARRANGEMENT FOR CLEANING THE SCREENING DEVICE OF A SCREEN

(75) Inventors: Juha Junnila, Rauma (FI); Jouko Måkilå, Vasarainen (FI)

(73) Assignee: Raumaster Oy, Rauma (FI)

( * ) Notice: Subject to any disclaimer, the term of this patent is extended or adjusted under 35 U.S.C. 154(b) by 0 days.

(21) Appl. No.: 10/083,498

(22) Filed: Feb. 27, 2002

(65) Prior Publication Data

US 2002/0153286 A1 Oct. 24, 2002

(30) Foreign Application Priority Data

Mar. 6, 2001 (FI) ..... 20010442

(51) Int. Cl.[7] ..... B07B 1/50
(52) U.S. Cl. ..... 209/380; 209/379; 209/309
(58) Field of Search ..... 209/380, 379, 209/308, 309

(56) References Cited

U.S. PATENT DOCUMENTS 3,477,571 A * 11/1969 Maag ..... 209/250
4,282,090 A 8/1981 Hoernschemeyer et al. 209/291

* cited by examiner

*Primary Examiner*—Donald P. Walsh
*Assistant Examiner*—Jonathan R Miller
(74) *Attorney, Agent, or Firm*—Nixon & Vanderhye P.C.

(57) ABSTRACT

The invention relates to a method and an arrangement for cleaning the screening device (2) of a screen (1). The screen (1) comprises at least said screening device (2) which has openings for the separation of particles of different sizes into fine material and coarse material, an actuator means for moving the screening device, a first conveying means (4) for guiding the material to be screened to the screening device (2) of the screen and a second conveying (8) means for moving the fine material that has passed through the screening device (2) and means (9) for guiding the separated coarse material away from the screen (1). For cleaning the screening device (2) a material is blown with the pressure medium at least at intervals through the screening device (2) in the opposite direction regarding fine material passing through, the particle size of which material being at least mainly smaller than the size of the openings of the screening device (2).

18 Claims, 1 Drawing Sheet

METHOD AND ARRANGEMENT FOR CLEANING THE SCREENING DEVICE OF A SCREEN

Figure 1:
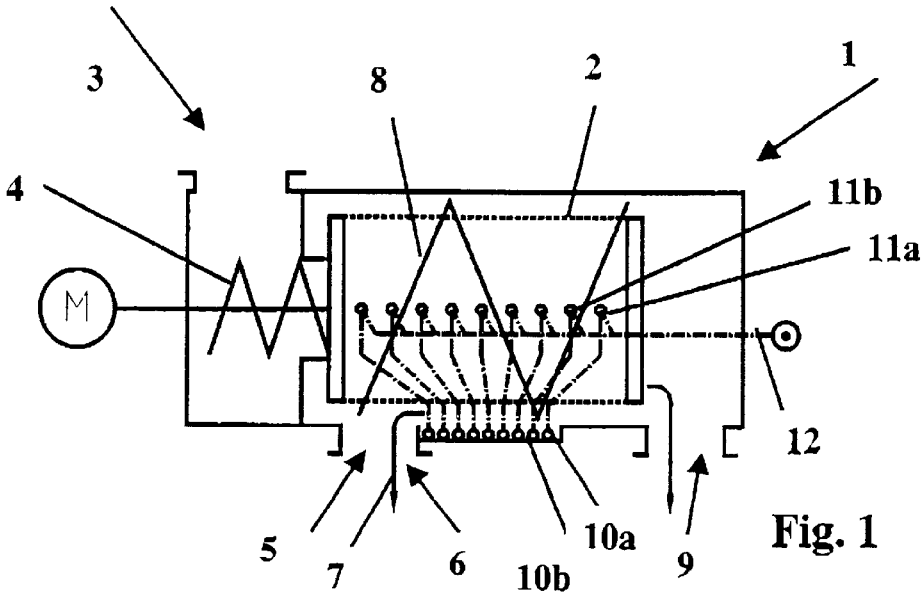

The invention relates to a method and arrangement for cleaning the screening device of screen while separating fine material and coarse material from material conducted to the screen with the aid of the screen according to the preambles of the independent claims presented below.

The characteristics of screens often include that the screens clog in some way. The occurrence of the phenomenon depends of course largely on the consistency and characteristics of the material to be screened. However, it is fairly common that the screening device of the screen, generally the screen mesh or screen plate clogs and the operation of the screen is disturbed, or even ceases. The screening effect may in a short period of time decrease to a fraction of the normal and then measures have to be taken to restore operational capacity of the screen. Such work is often quite cumbersome, as the screen may be large and it may have to be not only emptied but also partly disassembled in order to replace some parts with new or repaired ones. This is normally very time-consuming, whereby the screen is totally out of service and even disruptions to the manufacturing process may occur. Arrangements are known, where the screen is attempted to be cleaned with the aid of pressurised air, but is has been observed that such solutions are relatively ineffective and the screen must in any case most often be opened and for the larger part disassembled and reassembled. The work is often dirty, even hazardous.

The object of the invention is to avoid the above-mentioned disadvantages and to present a screen solution, in which the screen does not have to be opened for cleaning at all and in which the cleaning can be done while the screen is in operation. A further object of the invention is to present a solution where either separated fine material or some external material suitable for the purpose is used for the cleaning of the screen or at the same time for adding of material to the screen and thereby simultaneously in the material that passes through the screening apparatus.

The object of the invention is achieved in the manner disclosed in the independent claims and other claims presented hereinafter. The method according to the invention is used for cleaning the screening device of the screen while the screen is in operation. At least said screening device is arranged in the screen, which screening device has openings for separating components of different sizes of the material to be screened into fine material and coarse material, an actuator means for moving the screening device, a conveying means for conducting the material to be screened to the screening device of the screen and a conveying means for moving the fine material that has passed through the screening device and means for conducting the separated coarse material away from the screen. If a material is blown for cleaning the screening device at least at intervals among the pressure medium in the opposite direction regarding the fine material passing through the screening device, the particle size of which material being at least mainly smaller than the size of the openings in the screening device, the screening device of the screen is efficiently cleaned of the fine material to be screened caught in the openings of the screening device and thus the screening device of the screen is cleaned at the spot where the blow is directed and the operational ability of the screen is at least near the optimal.

If gas is used as the pressure medium, in which at least the main part is pressurised air, the pressurised air has no detrimental effect to most materials to be screened. Pressurised air is also commonly available in such places where screens are used. Furthermore, air is inexpensive and not dangerous.

If material is added to the pressure medium which mainly comprises fine material that has passed through the screening device, the cleaning of the screening device is effective and the screen is easily maintained in operational and effective status. During operation of the screen said fine material is furthermore always available for such a circulation in the screen and therefore it is not necessary to arrange for the acquisition or adding of any additional material.

However, if material is added to said pressure medium which material is used for changing of characteristics of the material that passes through the screen, particularly fine material separated with the aid of the screening device, it is possible in this manner conveniently not only to add some suitable material to the screen but also to clean the screen during operation and to maintain it in working order and effective.

If the pressure medium and the material to be blown therewith is blown towards the screening device at least through one nozzle, an efficient effect is achieved by directing the blowing in such a manner.

If the blowing of the pressure medium and the material to be blown thereamong is arranged to be carried out at intervals the operating life span of the screening device of the screen can be lengthened, as the blow and the material travelling therewith wear the screen out.

If there is a plurality of said nozzles and if said blow is arranged only with one or at the most a few nozzles at a time, it is possible to clean almost the entire area of the screening device of the screen even with a relatively small amount of the pressure medium to be blown. No problems will arise regarding the removing of the pressure medium to be blown from inside of the screen because of the relatively small amounts.

If a control unit is to be used for guiding the operation of said blowing nozzles, the operation of which unit is guidable, the suitably effective cleaning effect can be chosen for each purpose of use and for each operating situation.

If the screening device and the blow nozzle are arranged to be in movement with regard to each other, the cleaning effect is efficient within a large area, even within the entire area of the openings of the screening device.

Figure 2:
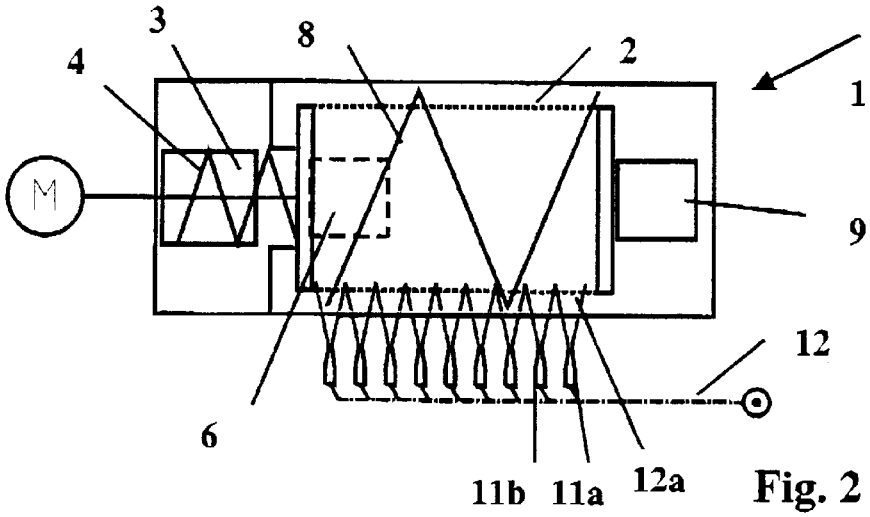
Figure 3:
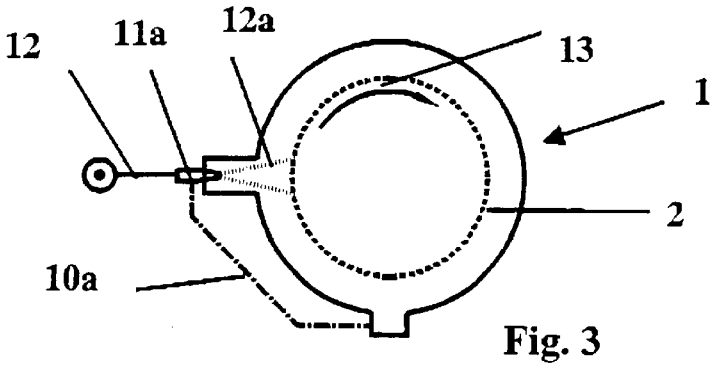

In the following the invention is described in more detail with reference to the enclosed drawing, in which FIG. 1 shows schematically an application of method according to the invention for cleaning of the screening device of the screen in a side view and applied to a drum screen, FIG. 2 shows schematically an arrangement according to FIG. 1 as a top view and FIG. 3 shows schematically an arrangement according to FIG. 2 as seen from the end of the screen.

A drum screen is indicated with reference number 1 in FIG. 1 of the drawing, with the aid of which fine and coarse material is separated from the material to be fed into the screen. A typical application of the drum screen is screening the ash on the bottom of a fluidised bed furnace. In the drum screen there is a screening drum 2, which is rotated by the combination of an electrical engine and usually a reduction gear M while the axle is nearly horizontal. The material to be screened is introduced through an inlet opening 3 to a conveyor screw 4, which conveys the material into the screening drum 2. The screening drum 2 rotates slowly, e.g. 10–50 laps per minute, whereby the fine material of the material to be screened is able to travel through the openings in the screening mesh or screening plate of the screening drum 2 with the aid of earth's gravity to a fine material trough 5 arranged in the lower part of the screen 2, from which trough the material travels in the direction of the arrow 7 through the fine material outlet 6 to e.g. a conveyor (not shown). In the fine material trough 5 the gear conveyor 8 joined with the screening drum 2 moves the fine material to the outlet opening 6. Coarse material which will not fit through the openings in the screening drum 2 to the fine material trough 5, travels along the inside of the screening drum 2 to the other end thereof and falls into the outlet opening 9, wherefrom it can be moved elsewhere with the aid of some conveying means (not shown). In the fine material trough 5 there is arranged a plurality of suction pipes 10*a*, 10*b*, etc., the ends of which are close to the lower part of the fine material trough 5. The other ends of the suction pipes 10*a*, 10*b*, etc. have been connected to blowing devices 11*a*, 11*b*, etc., arranged in the side of the drum screen 1 into which blowing devices also pipes from the pressurised air input pipe 12 have been connected. The cleaning of the screening device of the screen 1 i.e. the screening drum 2 is performed in such a manner that the blowing device 11*a* blows pressurised air from its nozzle from a suitable distance toward the screening drum 2, which may vary within wide limits, being, however, most usually between 10–40 cm. At the same time, fine material is slung out from the nozzle which material has been sucked by the blowing device 11*a* from the fine material trough 5 with the aid of the underpressure created. Due to the effect of the particles in the fine material the blowing device 11 a works like a typical sandblasting device, but naturally not quite as effectively since the fine material particles are as a blowing material at least somewhat more inefficient than regular sandblasting sand. In order to keep the consumption of the pressure medium low and not to wear the screening device 2 out quickly because of the blowing and fine material particles, it is generally necessary to arrange the guiding of the blowing devices 11*a*, 11*b*, etc. so that the blowing devices 11*a* operate only at intervals and only one or a few blowing devices are simultaneously in operation. Such an arrangement is made by placing a programmable controlling unit (not shown) to guide the blowing devices 11*a*, 11*b*, etc. The drum screen 1 can be conventional regarding its other parts and devices—the end of the drum screen (1) should be easy to open (not shown) for changing of the screening drum 2 when required, the screening drum 2 may be somewhat inclined and observation glasses or hatches (not shown) may be positioned at suitable locations.

Correspondingly, if some other material than screened fine material is used as added cleaning and/or other material, it is necessary to provide a container outside the screen, from which such other material is sucked and blown in the screen. The suction pipes 10*a*, 10*b*, etc. are in that case arranged inside said container close to the container's bottom. It has to be observed that such other material may not, regarding its particle size, be too large or form clods, as this prevents the suction of the material with the aid of underpressure and the blowing nozzles are not able to sling out very large particles or the like. One possibility is to position the said container higher up than the blowing nozzles (not shown), whereby the suction may succeed better. Above-mentioned programmable control unit or the like is recommended for the portioning.

In the depiction of FIG. 2 the positioning and operation of the blowing devices 11*a*, 11*b*, etc. is particularly discernible. The reference number 12*a* shows the cleaning jet created by the blowing device 11*a*, the cone of which jet is substantially affected by the choice of nozzle. The positioning, number, operating pressure, measurement of suction pipes, the operation of the programmable control unit of the blowing devices and other such matters are always compromises and in the choice of construction it is necessary to take into account all matters that affect the operation of the devices for each purpose of use and situation of use.

FIG. 3 shows in particular the positioning of the devices. If the blowing devices 11*a*, 11*b*, etc. are positioned approximately at the same height as the axle of the screening drum 2, the suction pipes 10*a*, 10*b*, etc. will not become too long and therefore the suction height from the fine material through 5 to the blowing devices 11*a*, 11*b*, etc. does not become so high, that the fine material would not rise along the pipe 10*a*, 10*b*, etc. to the blowing devices 11*a*, 11*b*, etc. because of the underpressure created in the blowing device 11*a*, 11*b*, etc. It is possible, that the blowing devices 11*a*, 11*b*, etc. are positioned lower and even on the opposite side of the screening drum 2 and even slightly lower, since because of the rotation movement of the screening device 2 as indicated by the arrow 13 the material to be screened in the walls of the screening drum 2 is lower on that side. Therefore the blowing and at the same time cleaning effect is more efficient, because the cleaning jet 12*a* can affect the screening drum 2 without the material to be screened inside the drum at that location.

The invention can be applied to other types of screens as well, e.g. a fiat screen (not shown). However, it is necessary to arrange the screening device and blowing devices 11*a*, 11*b*, etc. of the fiat screen mobile regarding each other, so that due to the effect of the cleaning jets 12*a*, 12*b*, etc. at least substantially the entire screening device will be cleaned with the aid of the cleaning jets 12*a*, 12*b*, etc.

The invention is not to be limited to the above application but several of its variations are thinkable within the scope of the enclosed claims.

What is claimed is:

1. Method for cleaning of the screening device of a screen, in which screen there has been arranged at least said screening device which has openings for the separation of particles of different sizes into fines and coarses;

an actuator means for moving the screening device;

a first conveying means for guiding the material to be screened to the screening device of the screen;

a second conveying means for moving the fines that have passed through the screening device; and means for guiding the separated coarses away from the screen, wherein said method comprises blowing a gas pressure medium at least at intervals through the screening device in a direction opposite to the direction of the fine material passing through the screening device, and cleaning the screening device by providing the gas pressure medium with a cleaning material having a particle size being at least mainly smaller than the size of the openings of the screening device.

2. Method according to claim 1, wherein at least a main part of the gas pressure medium is pressurised air.

3. Method according to claim 1, wherein the cleaning material which is added to said gas pressure medium mainly comprises fines that have passed through and have been separated by the screening device.

4. Method according to claim 1, which further comprises adding an effective additive to said gas pressure medium for changing the characteristics of at least the fines which are separated with the aid of the screening device.

5. Method according to claim 1, wherein the gas pressure medium and the cleaning material to be blown therewith is blown towards the screening device through at least one nozzle.

6. Method according to claim 5, wherein blowing of the pressure medium and the cleaning material therewith is practiced at intervals.

7. Method according to claim 5, wherein there is a plurality of said nozzles and wherein said blowing is practiced with at most a few nozzles at a time.

8. Method according to claim 7, wherein operation of said blowing nozzles is accomplished with the aid of a controlling unit.

9. Method according to claim 5, wherein the screening device and the at least one blowing nozzle are positioned for movement relative to one another.

10. Arrangement for cleaning a screen, which screen comprises at least:

a screening device which has openings for separating particles of different sizes into fines and courses;

an actuator means for moving the screening device, a first conveying means for guiding the material to be screened to the screening device of the screen;

a second conveying means for moving the fines that have passed through the screening device; and guide means for guiding the separated coarses away from the screen, and wherein said arrangement further comprises;

blowing means for blowing at least in intervals gas pressure medium through the screening device in a direction which is opposite to the direction of the fines passing through the screen with the aid of the gas pressure medium, and wherein said gas pressure medium includes a cleaning material having a particle size which is at least mainly smaller than the size of the openings of screening device, wherein blowing of the gas pressure medium and cleaning material through the screening device causes the screening device to be cleaned.

11. Arrangement according to claim 10, wherein at least a main part of the gas pressure medium is pressurised air.

12. Arrangement according to claim 10, wherein the cleaning material which is added to said gas pressure medium mainly comprises fines that have passed through and have been separated by the screening device.

13. Arrangement according to claim 10, wherein said said gas pressure medium further comprises an effective additive for changing the characteristics of at least the fines which are separated with the aid of the screening device.

14. Arrangement according to claim 10, which further comprises at least one nozzle for blowing the gas pressure medium and the cleaning material towards the screening device.

15. Arrangement according to claim 14, wherein said at least one nozzle blows the pressure medium and the cleaning material therewith at intervals.

16. Arrangement according to claim 14, further comprising a plurality of said nozzles and wherein only at most a few nozzles at a time blow the pressure medium and the cleaning material therewith.

17. Arrangement according to claim 16, further comprising a control unit for guiding the operation of said blowing nozzles.

18. Arrangement according to claim 14, wherein the screening device and the at least one blowing nozzle are mounted for movement relative to one another.

* * * * *

UNITED STATES PATENT AND TRADEMARK OFFICE

CERTIFICATE OF CORRECTION

PATENT NO. : 6,726,023 B2
DATED : April 27, 2004
INVENTOR(S) : Junnila et al.

It is certified that error appears in the above-identified patent and that said Letters Patent is hereby corrected as shown below:

Title page,
Item [75], Inventors, change "Jouko Måkilå, Vasarainen (Fl)" to -- Jouko Mäkilä, Vasarainen (Fl) --

Signed and Sealed this

Thirteenth Day of July, 2004

JON W. DUDAS
*Acting Director of the United States Patent and Trademark Office*